US005119279A

United States Patent [19]

Makowsky

[11] Patent Number: 5,119,279

[45] Date of Patent: Jun. 2, 1992

[54] LIGHTED DRINKING VESSEL

[76] Inventor: Gary R. Makowsky, P.O. Box 131034, Houston, Tex. 77219

[21] Appl. No.: 739,326

[22] Filed: Aug. 1, 1991

[51] Int. Cl.[5] ..... F21V 33/00

[52] U.S. Cl. ..... 362/101; 362/234; 362/800

[58] Field of Search ..... 362/101, 96, 154, 234, 362/251, 800, 806; 40/406

[56] References Cited

U.S. PATENT DOCUMENTS 2,663,866 12/1953 Simpson ..... 362/101 X
3,374,344 3/1968 Rudolph et al. ..... 362/101
4,922,355 5/1990 Dietz et al. ..... 362/101

*Primary Examiner*—Stephen F. Husar
*Attorney, Agent, or Firm*—Neal J. Mosely; Kenneth A. Keeling

[57] ABSTRACT

A drinking vessel including a mug having a liquid-tight volume therein, a base detachably connected to the mug, and a plurality of lights extending radially outwardly through the base so as to direct light outwardly from the base. The base has a cylindrical portion and a bottom surface. The base defines a liquid-tight volume therein. A power supply is contained within this liquid-tight volume so as to provide power to the plurality of lights. A switch is attached to the base and extends through the exterior wall of the base. The switch and the power supply are electrically connected to the plurality of lights. A sequencer is positioned within this liquid-tight volume so as to control the light actuation pattern of the plurality of lights. The base is in snap-fit connection with the mug. Each of the plurality of lights is a light-emitting diode spaced at even intervals from adjacent lights. The plurality of lights extend outwardly beyond the exterior surface of the base.

15 Claims, 1 Drawing Sheet

LIGHTED DRINKING VESSEL

TECHNICAL FIELD

The present invention relates to drinking vessels in general. More particularly, the present invention relates to drinking vessels that include lights or other forms of illumination.

BACKGROUND ART

Mugs, and other drinking vessels, are in quite common usage. Mugs are commonly used to serve soft drinks, beer, or other beverages. Many times, the mugs are utilized in dimly-lit environments.

In dimly-lit environments, it would be extremely helpful to utilize mugs that have lights or other forms of illumination. In addition, the use of lights can be attractive to the users and can provide a form of amusement. The employment of lights on a drinking vessel can further attract attention to the user of the drinking vessel.

A variety of U.S. patents have issued, in the past, for illuminated beverage vessels. Virtually all of these prior art patents have employed old technology. Generally, these prior art patents have not provided a plurality of lights and have not directed the light in a radial pattern from the mug.

U.S. Pat. No. 4,922,355, issued on May 1, 1990, to Dietz et al. describes a two compartment vessel having an upper compartment for containing a liquid and a lower compartment for containing an electrical circuit including a lamp. A light transmitting wall separates the two compartments. A set of spaced electrical contacts disposed on the vessel are connected to the electrical circuit. In response to the lowering of the electrical impedance between the contacts as caused by moisture bridging the gap between the contacts, the lamp is actuated to shine light into the upper compartment. A set of contacts is disposed on the handle of the mug. When the handle of the mug is grabbed, the moisture on the surface of the skin of the user causes a lowering of the electrical impedance and illumination will occur in response to such lowering of electrical impedance.

U.S. Pat. No. 3,735,113, issued on May 22, 1973, to T. H. Stott shows an illuminated wine glass. This optical display is made in the form of a wine glass having a hollow stem, a double walled bowl with an interior chamber communicating with the stem, and a bundle of optical fibers extending through the stem into the chamber where the terminal ends of the bundle are spread out by the chamber walls. A removable light, a switch, and a battery package are mounted in the base of the glass for shining light into the fiber bundle.

U.S. Pat. No. 3,878,386, issued on Apr. 15, 1975, to D. Douglas shows a lighted beverage glass having a stem with a central bore extending therethrough. A cup-shaped glass mounting portion is provided at the top of the stem and has a glass shell member removably mounted therein. A plurality of horizontally extending gripping ribs are provided on the mounting portion to securely retain the glass therein. A light assembly is mounted in this central bore of the stem for directing light through the bottom of the glass. The light assembly includes an electric bulb, a dry cell battery, and a spring member mounted between the bulb and the battery. The annular shoulder serves as a seat for the electric bulb.

U.S. Pat. No. 4,034,213, issued on Jul. 5, 1977, to F. J. Norris describes an illuminating insert for a drinking glass. A battery pack, having a suction cup, is provided for mounting in a glass. The battery pack is connected to a cap which contains a light-emitting diode and a magnifying lens with an insert between the pack and the cap.

U.S. Pat. No. 919,691, issued on Apr. 27, 1909, to J. H. Cahill shows another form of electrically illuminated drinking glass. This drinking glass contains an incandescent electric lamp. A sub-base is provided which contains an electric battery. Suitable electric connections are provided between the battery and the lamp so as to cause the lamp to become illuminated. The purpose of this electrical illumination is to enhance the appearance of champagne bubbles within the glass.

U.S. Pat. No. 2,663,866, issued on Dec. 22, 1953, describes an illuminated drinking glass. A lamp is provided which directs light upwardly through an intermediate base of the drinking glass. A display is provided so as to present visual information to the drinker after the liquid is consumed. The sub-base is attached to the drinking vessel by threaded connections.

U.S. Pat. No. 3,374,344, issued on Mar. 19, 1968, to Rudolph et al. shows a lighted beverage glass having a hollow stem and a glass shell member removably mounted thereon. A unitary cartridge assembly is slidably inserted into the stem. This assembly includes a main body portion and a transparent tip member mounted at one end. A lamp holder member, a bulb, a compression spring, and a battery are mounted inside the body portion with the bulb positioned adjacent the transparent tip member. A switch knob member is threaded into the base of the cartridge body and adapted for manual rotation so as to turn the light bulb on and off. The light passing through the transparent tip of the cartridge assembly passes upwardly through the bottom of the glass shell portion into the liquid thereon.

U.S. Pat. No. 2,604,579, issued on Jul. 22, 1952, to C. Deneboudes shows an ice bucket having a plurality of light bulbs which are arranged at generally equal intervals so as to direct light toward the interior of the ice bucket.

It is an object of the present invention to provide a drinking vessel having a plurality of lights incorporated therein.

It is another object of the present invention to provide a drinking vessel having light directed radially outwardly from the drinking vessel.

It is a further object of the present invention to provide a drinking vessel which uses light-emitting diodes for an illuminating effect.

It is still a object of the present invention to provide an illuminating drinking mug in which a detachable base member can be easily fastened to a mug.

It is still another object of the present invention to provide an illumination mechanism for a drinking mug which is easy to manufacture, simple to assemble, reliable in operation, and relatively inexpensive.

These and other objects and advantages of the present invention will become apparent from a reading of the attached specification and appended claims.

SUMMARY OF THE INVENTION

The present invention is a drinking vessel that comprises a body having a fluid-retaining volume therein, a base extending downwardly below the bottom of the fluid-retaining volume, a plurality of lights positioned on the base for directing light outwardly from the base, and a switch attached to the base for actuating the plurality of lights. The fluid-retaining volume of the body opens at one end to the body. The bottom is located opposite the opening of the fluid-retaining volume. The body includes a generally cylindrical wall. The fluid-retaining volume is interior of this cylindrical wall. The bottom extends across the cylindrical wall. The body further includes a handle that is connected to and extends outwardly from the cylindrical wall in a position above the base.

The base comprises a cylindrical portion extending downwardly from the cylindrical wall of the body and a bottom surface extending across the cylindrical portion opposite the body. The cylindrical portion and the bottom surface define a liquid-tight volume therein. The bottom surface is a planar surface generally parallel to the bottom of the body. The cylindrical portion is in either snap-fit relationship or in threaded relationship with the cylindrical wall of the body. The plurality of lights comprise a plurality of light-emitting diodes that extend through the cylindrical portion of the base. These light-emitting diodes are spaced at generally even intervals relative to each other. The light-emitting diodes extend outwardly for a small distance beyond the exterior surface of the base. The plurality of lights are in electrical connection with the switch. The electrical wiring for the plurality of lights and the switch are contained within the liquid-tight volume of the base.

The switching system of the present invention includes a switch that extends through the cylindrical portion of the base in liquid-tight relationship therewith. The switch is movable between an on position and an off position. A sequencer is positioned within the liquid-tight volume of the base. This sequencer is electrically connected to the plurality of lights and to the switch. The sequencer serves to control the light-actuation pattern of the plurality of lights. A battery is also positioned within the liquid-tight volume. This battery is electrically connected to the plurality of lights and to the switch. The battery serves to supply power to the lights.

DETAILED DESCRIPTION OF THE INVENTION

Figure 1:
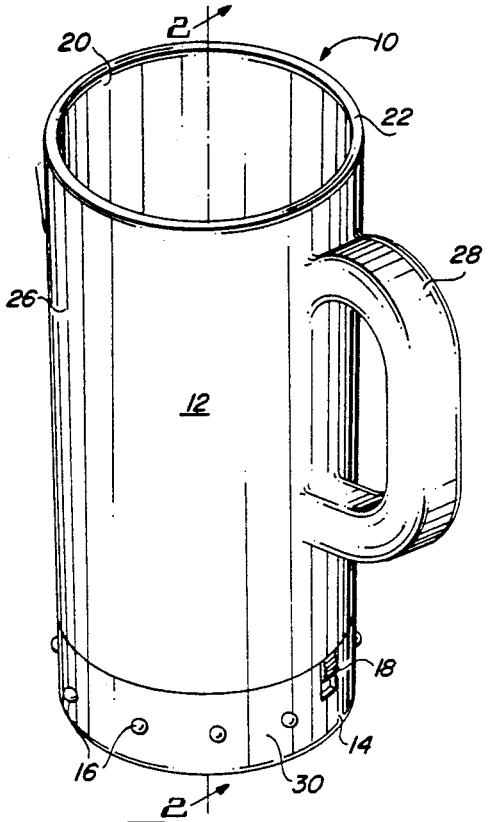
FIG. 1 is a perspective view of the illuminated drinking vessel of the present invention.

Referring to FIG. 1, there is shown at 10 the drinking vessel in accordance with the preferred embodiment of the present invention. Drinking vessel 10 comprises a body 12, a base 14, a plurality of lights 16 and a switch 18.

The body 12 resembles a standard drinking mug. The body 12 has a fluid-retaining volume 20 formed therein. The fluid-retaining volume 20 opens at end 22. End 22 is generally shown as the rim of the mug 12. The fluid-retaining volume 20 also has a bottom 24 (shown in FIG. 2) formed opposite the opening 20. Specifically, the body 12 has a generally cylindrical wall 26. The fluid-retaining volume 20 is formed interior of the cylindrical wall 26. The bottom 24 extends across the cylindrical wall. The body 12 also includes a handle 28 that is connected to the cylindrical wall 26 and extends outwardly therefrom. The handle 28 is positioned above the base 14. The handle 28 should have a size suitable for accommodating a human hand. The handle 28 could be used so as to bring the drinking vessel 10 in close proximity with the mouth of the user.

As can be seen in FIG. 1, the base 14 is positioned in close juxtaposition to the bottom of the body 12. Although the base 14 is shown as being flush with the surface of the cylindrical wall 26, it is possible for the body 14 to have a greater diameter, or a smaller diameter, than the cylindrical wall 26. The base 14 supports the body 12 on a surface, such as a table. The base 14 should be configured so as to provide stability and support to the body 12 of drinking vessel 10. As will be described hereinafter, there are a variety of techniques for connecting the base 14 to the bottom of the body 12.

The base 14 has a plurality of lights 16 that extend outwardly therefrom. The lights 16 are configured so as to direct light radially outwardly from the outer surface 30 of the base 14. As can be seen, the lights 16 are arranged at generally equal intervals around the circumference of the base 14. The switch 18 is also positioned on the base 14. The switch 18 is movable between an "on" position and an "off" position. The switch 18 extends through the wall of the base 14 so as to be accessible by the user of the drinking vessel 10. The switch 18 may be manipulated so as to control the actuation of the lights 16.

Figure 2:
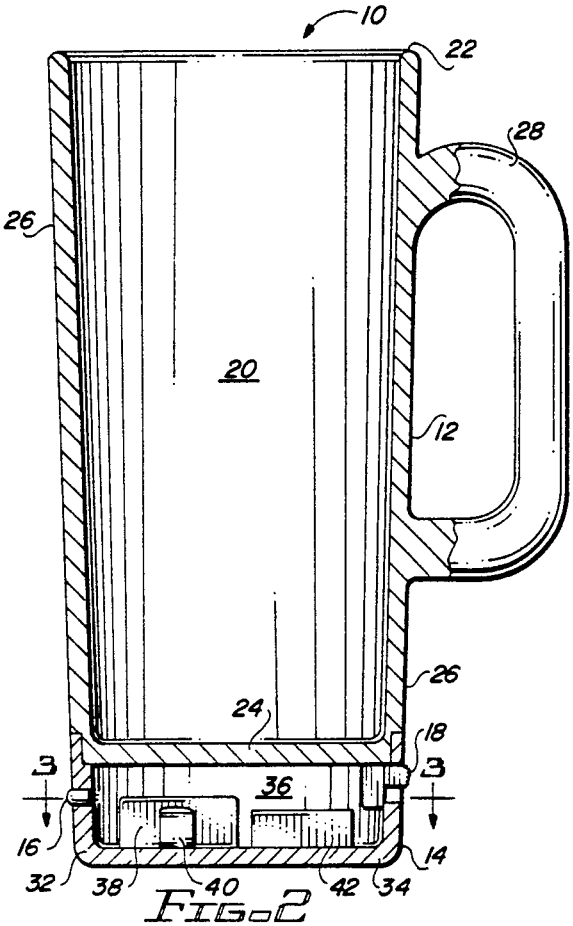
FIG. 2 is a cross-sectional view, in side elevation, taken across lines 2—2 of FIG. 1.

FIG. 2 shows a cross-sectional view of the drinking vessel 10. As can be seen, the drinking vessel 10 includes the fluid-retaining volume 20 therein. The cylindrical walls 26 extend upwardly from the bottom 24 so as to define the area of the fluid-receiving volume. The rim 22 is formed at the end of the cylindrical wall 26 opposite the bottom 24. Handle 28 extends outwardly from the cylindrical wall 26. In normal manufacturing procedures, the cylindrical wall 26, the bottom 24, and the handle 28 are integrally formed together through plastic molding processes or glass manufacturing processes.

In FIG. 2, it can be seen that the base 14 is fastened to the bottom 24 of the body 12 of drinking vessel 10. As described in conjunction with FIGS. 4 and 5, the base 14 may be fastened to the body 12 by snap-fitting, by threading, or by any other suitable means.

The base 14 has a generally cylindrical portion 32 which extends downwardly from the cylindrical wall 26 of the body 12. The base 14 also includes a bottom surface 34 that extends across the cylindrical portion 32. The bottom surface 34 is positioned opposite the body 12. The cylindrical portion 32 and the bottom surface 34 define a liquid-tight volume 36 therein. The liquid-tight volume 36 is bounded by the cylindrical wall 32, the bottom surface 34, and the bottom 24 of body 12. The bottom surface 34 is a planar surface that is generally parallel to the bottom 24 of the body 12. The lights 16 extend through the cylindrical portion 32 so as to emit light exterior and in a radial direction from the drinking vessel 10. It can also be seen that the switch 18 also extends through the wall of cylindrical portion 32. The switch 18 is in a position to be easily manipulated by the user of the drinking vessel 10. A battery 38 is positioned within the liquid-tight volume 36. The battery 38 has a suitable capacity to supply the power requirements of the lights 16. Battery 38 is maintained in position within the interior volume 36 by a clip 40. An electrical circuit board 42 is also positioned within this liquid-tight volume 36. The circuit board 42 is electrically connected to the switch 18, to the battery 38, and to the lights 16. As will be described hereinafter, the circuit board 42 controls the operation of the lights and serves to sequence the actuation of the lights.

Figure 3:
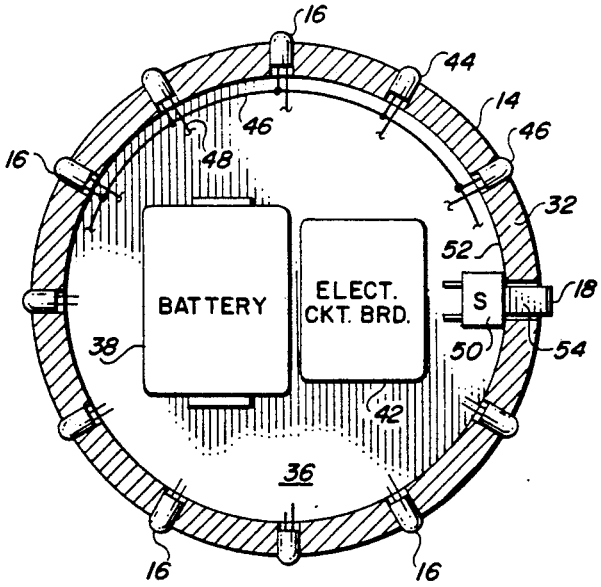
FIG. 3 is a cross-sectional view taken across lines 3—3 of FIG. 2 showing, in particular, the arrangement of the interior of the base.

FIG. 3 shows the configuration of the base 14. It can be seen that the lights 16 extend through the cylindrical wall 32 of base 14. The lights 16 are light-emitting diodes that are securely fastened to the wall 32 and have a portion 44 which extends outwardly beyond the exterior surface 46 of cylindrical wall 32. The lights 16 are configured so as to direct light radially outwardly from the cylindrical wall 32 of base 14. Electrical wiring 46 is used to interconnect each of the lights 16 in a serial fashion. Each of the lights 16 has a line 48 which is used to directly connect to the electrical circuit board, to the switch, and to the battery. The electrical connection scheme, illustrated in FIG. 3, allows the lights 16 to be illuminated in the desired order, pattern, or arrangement. It can be seen that the battery 38 and the electrical circuit board 42 are positioned within the liquid-tight interior of base 14. The electrical circuit board 42 may include a sequencer circuit. The sequencer circuit provides for the actuation of the lights in the desired pattern. The sequencer may be activated by the actuation of the switch 18. Switch 18 includes a switch body 50 which is fastened along the interior wall 52 of base 14. The switch body 50 is fastened to the interior wall 52 in a fashion so as to prevent liquids from passing into the interior 36 of the base 14. It can be seen that the toggle 54 of switch 18 extends through the cylindrical wall 32 of base 14. The toggle 54 extends outwardly beyond the exterior surface 46 of cylindrical wall 32 for a small distance. This enhances the ability to easily manipulate the switch 18 as needed. The switch 18 is movable between an on position and an off position. In the on position, the lights 16 are activated, as desired. In the off position, the lights 16 are not illuminated.

Although the present invention shows the use of the switch 18, it should be kept in mind that a variety of other configurations could be employed. Base switch 18 could be replaced with a knob and rheostat which would allow for the adjustment of the light sequencing pattern or the intensity of the lights. The switch could have several positions which would allow the lights to be illuminated in alternating patterns, in flashing patterns, or in random patterns. The electrical circuit board 42 can be programmed so as to cause the lights to be illuminated in the patterns mentioned herein previously. The use and appearance of the switch 18, as illustrated herein, is not intended as a limitation on the scope of the present invention.

It can be seen that the lights 16 are spaced at generally even intervals along the circumference of the base 14. It has been found that the spacing of the lights 16 in even intervals adds to the aesthetically pleasing quality of the present invention. Each of the light-emitting diodes 16 can be inserted through the cylindrical wall 32 of base member 14. Suitable sealing materials can be used so as to prevent liquid intrusion through the openings for the lights 16. Since the drinking vessel 14 is used in wet environments, it is important to maintain the liquid-tight character of the electronics of the base 14.

Figure 4:
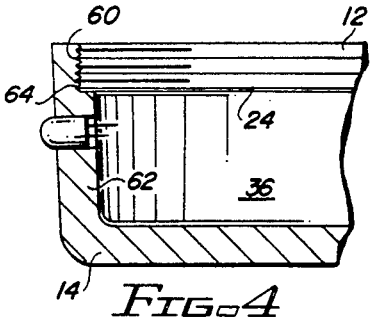
FIG. 4 is a segmented cross-sectional view showing the arrangement of the connection of the base member to the drinking vessel.

FIG. 4 illustrates one manner in Which the base member 14 may be attached to the body 12. It can be seen that the bottom 24 of the body 12 has threads 60 extending therearound. The base 14 has a cylindrical wall 62 which has matching threads 64. The threads of the wall 62 of base member 14 engage the threads 60 of the body 12. In this manner, the base member 14 can be removably fastened to the bottom 24 of the body 12. The tightening of the base member 14 along the threads 60 and 64 enhances the liquid-tight character of the interior volume 36 of the base member 14. The threads 60 and 64 can be created by suitable forming processes.

Figure 5:
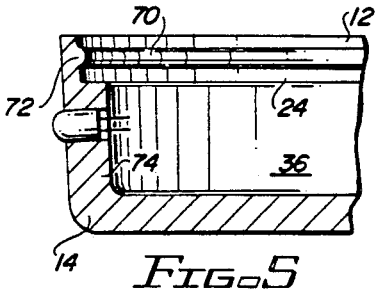
FIG. 5 shows an alternative embodiment of the connection of the base member to the drinking vessel.

FIG. 5 shows an alternative embodiment of the configuration of the FIG. 4. Specifically, it can be seen in FIG. 5 that the body 12 is fastened to the base 14 by a snap-fit arrangement 70. Specifically, the bottom 24 of body 12 has an indented notch 70. The indented notch 70 may be formed into the bottom 24 so as to receive a corresponding protrusion 72 of the base member 14. It can be seen that the base member 14 has the inwardly extending protrusion 72 formed along the upper edge of the cylindrical wall 74. This inwardly extending protrusion 72 will fit within the notch 70 so a to create the liquid-tight engagement between the base member 14 and the body 12. A pressurized snap-fitting of the base 14 to the body 12 can accomplish the purpose of causing the protrusion 72 to engage the notch 70. This creates a liquid-tight seal for the interior volume 36.

The present invention is a significant improvement over the prior art techniques for illuminating a drinking vessel. First, the present invention utilizes light-emitting diodes so as to create a long-term illumination effect. It would not be necessary to replace the light-emitting diodes because of burnout or failure. The light-emitting diodes create an aesthetically pleasing effect. The light-emitting diodes come in a wide variety of colors. Also, the light-emitting diodes are relatively easy to install.

The present invention also directs the light radially outwardly along the bottom of the mug. This creates an aesthetically pleasing effect to the user of the mug. When the novelty of the illumination is no longer pleasing then the user can simply manipulate the switch so as to turn out the lights. The use of the sequencer can provide an interesting pattern of light illuminations. The battery supplies power to the lights for a very long period of time.

The liquid-tight arrangement of the base member with the mug allows the illuminating base member to be used in very wet environments. When installed in the manner described herein previously, the base member 14 prevents liquid intrusion into the interior circuitry of the lights. Since the lights are illuminated with very low voltage and very low amperage, there is no danger of injury from shock.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A drinking vessel comprising:

a body comprising a generally cylindrical wall and having a fluid-retaining volume interior of said cylindrical wall, said fluid-retaining volume opening at one end of said body, said fluid-retaining volume having a bottom opposite the opening of said fluid-retaining volume extending across said cylindrical wall;

a base consisting of a cylindrical portion extending downwardly from said cylindrical wall of said body and extending downwardly along said bottom of said fluid-retaining volume, a bottom surface extending across said cylindrical portion opposite said body, said cylindrical portion and said bottom surface defining a liquid-tight volume therein, said cylindrical portion in detachable relationship with said cylindrical wall of said body;

a plurality of lights positioned on said base for directing light outwardly from said base; and switch means attached to said base, said switch means for actuating said plurality of lights.

2. The drinking vessel of claim 1, said cylindrical portion in snap-fit relationship with said cylindrical wall of said body.

3. The drinking vessel of claim 1, said cylindrical portion in threaded relationship with said cylindrical wall of said body.

4. The drinking vessel of claim 1, said plurality of lights comprising a plurality of light-emitting diodes extending through said cylindrical portion of said base.

5. The drinking vessel of claim 4, said plurality of lights in electrical interconnection with said switch means, said plurality of lights having electrical wiring within said liquid-tight volume.

6. The drinking vessel of claim 1 said switch means comprising:

a switch extending through said cylindrical portion of said base, said switch movable between an on position and an off position; and a sequencer means positioned within said liquid-tight volume, said sequencer means electrically connected to said plurality of lights and to said switch, said sequencer means for controlling a light actuation pattern of said plurality of lights.

7. An apparatus comprising:

a mug having a liquid-containing volume therein:

a base detachably connected to said mug, said base having a cylindrical portion and a bottom surface, said base having a liquid-tight volume therein:

a plurality of lights extending radially outwardly through said cylindrical portion of said base for directing light outwardly from said base;

power means contained within said liquid-tight volume, said power means for supplying power to said plurality of lights; and switch means attached to said base and extending through said cylindrical portion of said base, said switch means and said power means electrically connected to said plurality of lights, said switch means for actuating said plurality of lights.

8. The apparatus of claim 7, further comprising:

sequencer means positioned within said liquid-tight volume, said sequencer means electrically connected to said plurality of lights for controlling a light actuation pattern of said plurality of lights.

9. The apparatus of claim 7, said base being in snap-fit connection with said mug.

10. The apparatus of claim 7, said base being in threaded connection with said mug.

11. The apparatus of claim 7, each of said plurality of lights being a light-emitting diode, each of said plurality of lights spaced from an adjacent light by generally equal intervals.

12. The apparatus of claim 11, each of said plurality of lights in liquid-tight connection with said cylindrical portion of said base, said plurality of lights having a portion extending outwardly beyond an exterior surface of said base.

13. An improved drinking vessel, the improvement comprising:

a base detachably connected to said drinking vessel, said base having an exterior wall, a bottom surface, and a liquid-tight interior volume;

a plurality of lights fastened to and extending through said exterior wall, said plurality of lights for directing light radially outwardly from said base; and switch means connected to said base, said switch means for controlling an actuation of said plurality of lights.

14. The improvement of claim 13, said plurality of lights comprising a plurality of light-emitting diodes spaced at even intervals on said base, said light-emitting diodes having an electrical connection to said switch means, said electrical connection contained within said liquid-tight interior volume.

15. The improvement of claim 13, said switch means comprising:

a battery contained within said liquid-tight interior volume, said battery for supplying power to said plurality of lights;

a sequencer means positioned within said liquid-tight interior volume, said sequencer means electrically connected to said plurality of lights for controlling a light-actuation pattern of said plurality of lights; and a switch extending through said exterior wall in liquid-tight connection therewith, said switch movable between an on position and an off position, said switch in electrical connection with said sequencer means and said battery.

* * * * *